US005078307A

United States Patent [19]

Suddath

[11] Patent Number: 5,078,307

[45] Date of Patent: Jan. 7, 1992

[54] TWO-PART PLASTIC HANGER AND METHOD OF MANUFACTURING SAME

[75] Inventor: James N. Suddath, West Bloomfield, Mich.

[73] Assignee: Electroformed Products, Inc., Royal Oak, Mich.

[21] Appl. No.: 548,581

[22] Filed: Jul. 5, 1990

[51] Int. Cl.[5] ..... A47G 25/14; A47G 25/30; A47G 25/32; A47G 25/36

[52] U.S. Cl. ..... 223/92; 223/85; 223/88; D6/315; D6/318; D6/328

[58] Field of Search ..... 223/88, 85, 92, 95, 223/98, DIG. 1; 211/113; D6/315, 318, 328

[56] References Cited

U.S. PATENT DOCUMENTS

| | | | |
|---|---|---|---|
| 1,321,997 | 11/1919 | Duberstein . | |
| 1,805,573 | 5/1931 | Dinsmore . | |
| 2,155,071 | 4/1939 | Young | 223/92 X |
| 2,160,128 | 5/1939 | Coney | 223/92 X |
| 2,160,129 | 5/1939 | Coney | 223/92 |
| 2,160,173 | 5/1939 | Ruen | 223/92 |
| 2,160,188 | 5/1939 | Young | 223/92 |
| 2,373,000 | 4/1945 | Young | 223/88 |
| 2,435,111 | 1/1948 | Wahl | 223/95 |
| 2,563,704 | 8/1951 | Buffin | 223/88 |
| 2,574,963 | 11/1951 | Dwyer | 223/88 |
| 2,590,738 | 3/1952 | Tufts | 223/98 |
| 2,652,957 | 9/1953 | Wolf | 223/92 |
| 2,866,583 | 12/1958 | Batts | 223/88 |
| 3,460,727 | 8/1969 | Baughman | 223/98 |
| 3,727,297 | 4/1973 | Wesemann | 29/480 |
| 3,963,155 | 6/1976 | Bish | 223/88 |
| 4,058,241 | 11/1977 | Craig | 223/98 |
| 4,606,482 | 8/1986 | McHugh | 223/88 |

*Primary Examiner*—Werner H. Schroeder
*Assistant Examiner*—Bibhu Mohanty
*Attorney, Agent, or Firm*—Basile and Hanlon

[57] ABSTRACT

A two-part hanger includes a hook portion having first and second legs engageable by a second lower portion formed of first and second inclined shoulder rails integrally joined by a horizontal rail. A friction producing surface is applied to at least portions of the first and second shoulder rails and the horizontal rail. The method of manufacturing the two-part hanger includes the steps of injection molding a hook portion having first and second diverging legs and extruding a hollow tubular member. The hollow tubular member is bent at opposed ends to form first and second inclined shoulder rails joined by an integral horizontal rail. Flocking particles are sprayed over or, alternately, a plurality of strands are wound into an interknit braid over an adhesive coating applied to the elongated tubular member prior to the bending of the ends of the tubular member to form the frist and second inclined shoulder rails.

10 Claims, 1 Drawing Sheet

TWO-PART PLASTIC HANGER AND METHOD OF MANUFACTURING SAME

BACKGROUND OF THE INVENTION

1. Field of the Invention

The present invention relates, in general, to hangers and, more specifically, to plastic hangers.

2. State of the Art

Clothes hangers have been formed of a variety of materials including wire rods, wood, combinations thereof, and plastic. Such clothes hangers include a hook portion and two inclined, diverging shoulder rails connected to and extending from the hook portion. Typically, a horizontal rail is connected between the outer ends of the shoulder rails for strength and to support pants, etc., on the hanger.

Plastic hangers are formed as an integral one-piece assembly, typically, by injection molding. Due to the size and shape of the hanger, the mold cavity is necessarily large thereby enabling only one or just a few hangers to be produced in a single mold in each run cycle. The production rate of such plastic hangers is, therefore, low.

Friction producing surfaces, such as flocking, have been previously applied to portions of hangers to prevent clothes from falling off of the hangers. Typically, loose flocking fibers or particles are sprayed onto an adhesive coating previously sprayed onto the horizontal rail and/or portions of the shoulder rails. However, due to the triangular shape of the interconnected shoulder rails and the horizontal rail, a considerable amount of the sprayed adhesive do not contact the hanger and are wasted thereby increasing the production costs of applying a flocking surface to such hangers.

Thus, it would be desirable to provide a plastic hanger which overcomes the problems of previously devised plastic hangers, particularly those having a friction producing surface formed or applied to portions thereof. It would also be desirable to provide a plastic hanger which can be constructed at less expense and from lower cost material, in smaller molds and molding machines, and at higher production rates than previous plastic hangers. It would also be desirable to provide a plastic hanger having a friction producing surface applied to portions thereof which can be produced with less waste and at a lower cost than previously devised plastic hangers having such friction producing surfaces.

SUMMARY OF THE INVENTION

The present invention is a two-part plastic hanger, a method for manufacturing the same and a two-part plastic hanger preparable by the method.

The hanger includes a hook portion having first and second diverging legs. A second portion is engageable with the legs of the hook portion. The second portion includes first and second inclined shoulder rails, one end of each of which is engagable with the first and second legs, respectively, of the hook portion. A horizontal rail is integrally formed with and extends between one end of each of the first and second shoulder rails.

In a preferred embodiment, the hook portion and the second portion of the hanger are made of plastic. Preferably, the hook portion is injection molded and the second portion is extruded in a hollow, tubular form before the shoulder rails are bent into the desired, angular shape with respect to the planar, horizontal rail. At least the ends of the shoulder rails of the second portion are hollow so as to slidably receive the first and second legs of the hook portion therein.

Further, a friction producing surface is optionally applied to at least portions of at least one of the first and second shoulder rails and the horizontal rail. Preferably, the friction producing surface comprises flocking particles or fibers which are sprayed onto an adhesive coating also sprayed over portions of at least one of the first and second shoulder rails and the horizontal rail.

The method of manufacturing a plastic hanger comprises the steps of:

(a) forming a hook portion having a substantially U-shaped end and first and second diverging legs, (b) extruding a hollow tube having first and second ends from a plastic material, (c) bending the hollow tube at opposite ends to form first and second inclined shoulder rails integrally connected by a planar, horizontal rail, and (d) slidably engaging the first and second legs of the hook portion with the ends of the first and second shoulder rails.

In a preferred embodiment, the hook portion is formed by injection molding the hook portion from a suitable plastic material.

In an optional embodiment of the method of the present invention, a friction producing surface is applied onto at least portions of at least one of the first and second shoulder rails and the horizontal rail of the hanger. Preferably, certain portions of the first and second shoulder rails or the horizontal rail are first coated by an adhesive. Flocking particles or fibers are then sprayed over the adhesive coating so as to be attached to the first and second shoulder rails and the horizontal rail by the adhesive coating. Preferably, the adhesive and the flocking fibers are sprayed onto the second portion of the hanger before the first and second shoulder rails are bent into the desired shape with respect to the horizontal rail from the elongated, extruded tube.

Also disclosed is a two-part plastic hanger having a hook portion with first and second, inclined, depending legs preparable by the method of extruding an elongated, hollow tubular member from a plastic material having first and second ends and bending the first and second ends of the tubular member to form first and second inclined shoulder rails joined by an integral horizontal rail, the first and second ends of the shoulder rails being engageable with the first and second legs, respectively, of the hook portion. The hanger formed by this method also may be prepared by spraying flocking particles or fibers over an adhesive coating previously sprayed onto certain portions of the first and second shoulder rails and the horizontal rail.

The two-part plastic hanger of the present invention overcomes many of the problems encountered with previously devised plastic hangers. Since only the hook portions of the two-part plastic hanger is injection molded, smaller quantities of higher cost injection molding plastic are required. Further, the small size of the hook portion as compared to the conventional large one-piece hanger having both hook portions and shoulder and horizontal rails, enables smaller, less expensive molds and molding machines to be employed to manufacture the hanger. More parts can also be produced in each mold thereby significantly increasing production rates and further lowering the overall cost of the plastic hanger of the present invention.

By extruding the second portion of the hanger in a hollow, elongated tubular form, smaller dies and molding machines may be employed. Further, higher production rates and less expensive plastic materials may be employed for the second portion of the hanger.

The friction surface in the form of adhesively mounted flocking particles or fibers is applied onto the extruded tube before the shoulder rails are bent to the desired shape. This enables greater quantities of the sprayed adhesive to adhere to the hanger thereby significantly reducing waste and requiring smaller equipment and less floor space than previous methods for applying flocking to large, one-piece hangers.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
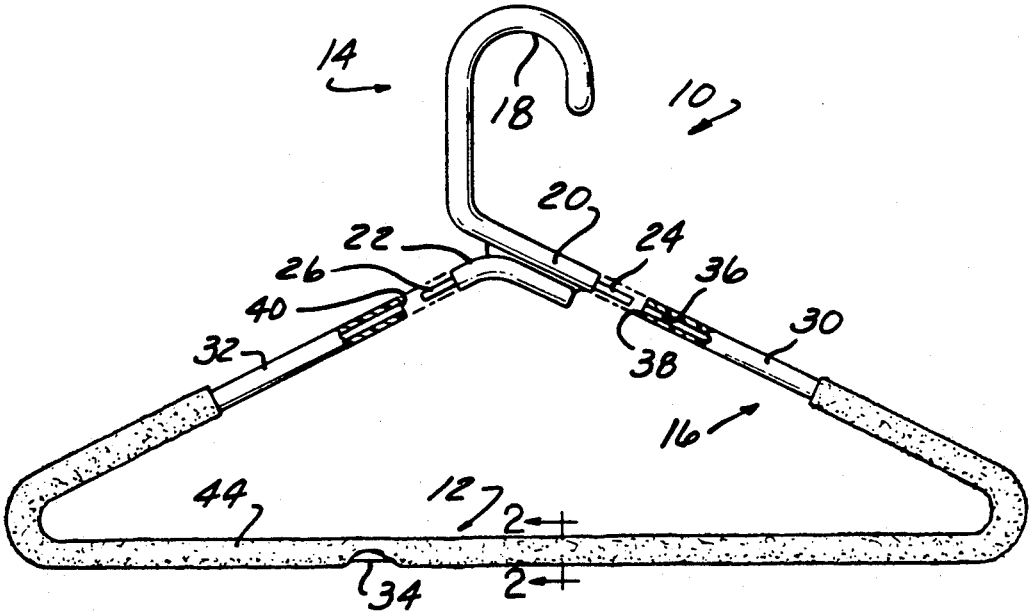
FIG. 1 is an exploded, front elevational view of a two-part hanger constructed in accordance with the teachings and method of the present invention.

Referring now to the drawing, and to FIG. 1 in particular, there is illustrated a two-part plastic hanger 10 constructed in accordance with the teachings of the present invention. The two-part hanger 10 also includes a friction producing surface 12 on portions thereof as described hereafter.

The two-part hanger 10 includes a first hook portion 14 and a second, lower portion 16. The hook portion 14 has a conventional, U-shaped end 18 and integral, first and second, inclined, diverging legs 20 and 22, respectively. The hook portion 14 is preferably formed as a one-piece member by injection molding in a single mold cavity. Any suitable plastic material may be used to form the hook portion 14 of the two-part hanger 10.

Optionally, reduced diameter end portions 24 and 26, each of which has a smaller diameter or outside dimension than the corresponding dimension of the first and second legs 20 and 22, extend outward from the ends of the first and second legs 20 and 22, respectively, as shown in FIG. 1.

The second lower portion 16 of the two-part hanger 10 includes first and second inclined legs 30 and 32, respectively. The first and second legs 30 and 32, which function as shoulder rails, are disposed at acute angles with respect to an integral, planar, horizontal rail 34. The horizontal rail 34 extends between one end of each of the first and second legs or shoulder rails 30 and 32 of the second lower portion 16 of the hanger 10.

As shown in FIG. 1, the second lower portion 16 is in the form of a hollow tubular member having an internal bore 36 extending therethrough from a first end 38 to a second end 40. Alternately, at least the end portions 38 and 40 of the first and second shoulder rails 30 and 32 are hollow; with the remainder of the first and second shoulder rails 30 and 32 and the horizontal rail 34 being formed as a solid member.

Optionally, a friction producing surface 12 is formed on at least certain portions of at least one or all of the first and second shoulder rails 30 and 32, respectively, and the horizotal rail 34, as shown in FIG. 1. The friction surface 12 is preferably formed by coating portions of the first and second shoulder rails 30 and 32 and/or the horizontal rail 34 with flocking fibers. Portions of the second lower portion 16 of the hanger 10 are first coated with a suitable adhesive prior to the flocking fibers being sprayed thereon. In this manner, the flocking fibers are adhesively attached to the second lower portion 16 and extend outward therefrom to form a friction producing surface for securely retaining garments on the first and second shoulder rails 30 and 32 and/or the horizontal rail 34.

Figure 2:
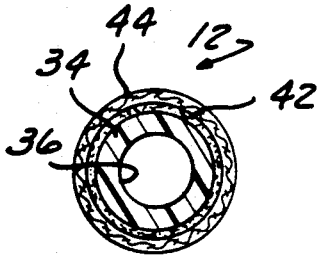
FIG. 2 is a cross sectional view generally taken along line 2—2 in FIG. 1.

As shown in FIG. 2, the flocking fibers 44 are disposed completely around the entire periphery of the horizontal rail 34. Optionally, only the uppermost surfaces of the side walls of the horizontal rail 34 and, similarly, the first and second shoulder rails 30 and 32 may be coated with the flocking fibers 44.

The method of manufacturing the two part hanger 10 and the two-part hanger 10 preparable by such a method includes the steps of:

(a) forming a hook portion having a substantially U-shaped end 18 and first and second inclined, diverging legs 20 and 22, (b) extruding a hollow tubular member 50 from an extrusion die which has first and second ends 38 and 40. The tubular member 50 is preferably formed of a suitable plastic material, such as a thermoplastic material, i.e., styrene, polypropylene, polyethylene or polyvinylchloride, etc., (c) bending the hollow tubular member 50 at opposite ends, as denoted by reference numbers 52 and 54 in FIG. 3, to form first and second inclined shoulder rails 30 and 32 shown in phantom in FIG. 3 which are connected by an integral, horizontal, planar rail 34 extending therebetween, and (d) slidably engaging the ends 38 and 40 of the first and second rails 30 and 32, respectively, with the first and second legs 20 and 22 of the hook portion 14.

In a preferred embodiment of the method, the hook portion 14 is formed by injection molding.

Figure 3:
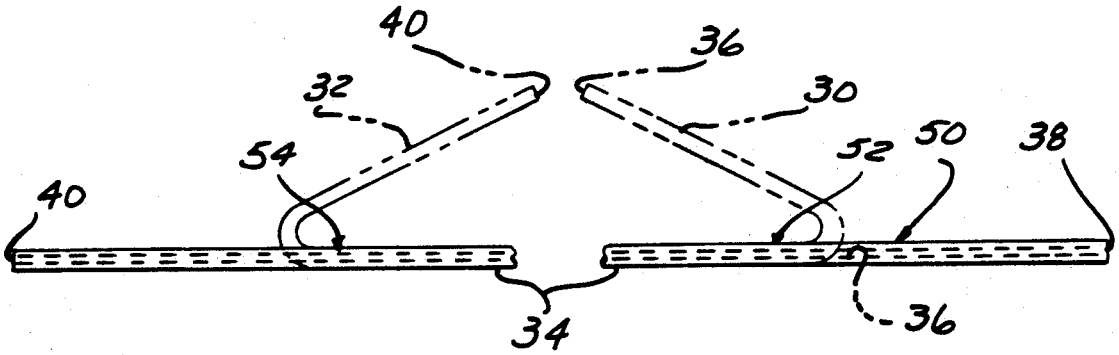
FIG. 3 is a side elevational view of the extruded tubular member used to form the second portion of the two-part plastic hanger shown in FIG. 1.

When a friction producing surface, such as flocking particles or fibers 44, is to be applied to certain portions of the second lower portion 16 of the hanger 10, a coating of a suitable adhesive 42 is applied to certain portions, such as the entire periphery of the horizontal rail 34 and substantially all of the entire periphery of the first and second shoulder rails 30 and 32. Preferably, the coating of adhesive 42 is applied to the elongated tubular member 50 immediately after the elongated tubular member 50 exits the extrusion dye and prior to the bending of the shoulder rails 30 and 32 into the desired angular position with respect to the horizontal rail 12, as shown in FIG. 3. Preferably, the coating of adhesive 42 is sprayed onto the tubular member 50 when the elongated tubular member 50 is at an elevated temperature after exiting the extrusion die or is raised to an elevated temperature through suitable heating means, not shown. The flocking fibers 44 are then sprayed onto the coating of adhesive 42 prior to the bending of the shoulder rails 30 and 32 to the desired angular shape shown in FIG. 3.

Figure 4:
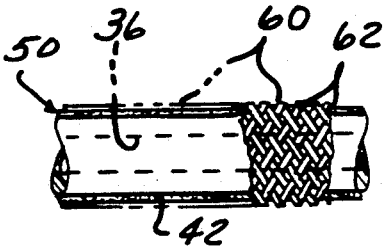
FIG. 4 is a partial, side elevational view of the extruded tubular member having another embodiment of the friction producing surface applied thereon.

In another embodiment shown in FIG. 4, the friction producing surface is formed of an interknit braid 60 of individual fiber strands 62. In this embodiment, the adhesive 42 is initially sprayed onto the elongated tubular member 50 immediately after the tubular member 50 exits the extrusion dye and prior to the bending of the shoulder rails 30 and 32 into the desired angular shape. A plurality of fiber strands 62 are then interknit by a conventional braiding machine over the coating of adhesive 42 to form a wound braid 60 which is secured to the tubular member 50 through the adhesive 42.

The friction producing surface may also be applied on the hanger 10 in a variety of other methods. For example, flocking can be attached to a thin fabric strip, such as a ribbon, which is then spiral wound over an adhesive coating previously applied to selected portions of the hanger 10. Alternately, a self contacting adhesive or a sprayed adhesive can be applied to the flocking strip or ribbon before the strip or ribbon is wound about the hanger 10.

Also disclosed in the present invention is a two-part plastic hanger having a hook portion with first and second inclined, depending legs preparable by the process of:

extruding an elongated hollow tubular member from a plastic material having first and second ends and bending the first and second ends to form first and second inclined shoulder rails joined by an integral horizontal rail. The first and second ends of the shoulder rails are engageable with the first and second legs, respectively, of the hook portion. Further, the two-part hanger preparable by the above-described process further includes the step of spraying flocking fibers over an adhesive coating previously sprayed onto certain portions of at least one of the first and second shoulder rails and the horizontal rail.

In summary, there has been disclosed a unique two-part hanger, method of producing the same and a two-part hanger preparable by the method which provides significant advantages over previously devised plastic hangers. By forming the hook portion with short depending legs, the hook portion may be injection molded in smaller dies and from smaller quantities of high cost injection molding plastic materials thereby decreasing the overall cost of the hanger of the present invention.

Extruding the second lower portion of the hanger as an elongated tubular member enables the use of less expensive materials and smaller dies and machines and, further, higher production rates to form the second lower portion of the hanger. All of these features significantly reduce the cost of the hanger of the present invention as compared to previously devised plastic hangers.

Further, spraying an adhesive coating and flocking fibers onto the elongated tubular member after the tubular member has been extruded and prior to the bending of the shoulder rails in the tubular member significantly reduces waste of the adhesive and permits such fibers to completely coat all or any desired portion of the periphery of the second lower portion of the hanger. This minimizes waste which decreases costs as well as lowers the amount of floor space and equipment required to apply flocking to hangers.

I claim:

1. A method for manufacturing a hanger comprising the steps of:

forming a hook portion having a substantially U-shaped end and first and second diverging legs;

extruding a hollow tubular member having first and second ends from a plastic material;

bending the hollow tubular member at opposite ends to form first and second inclined shoulder rails integrally connected by a horizontal rail; and slidably engaging the first and second legs of the hook portion with the ends of the first and second shoulder rails.

2. The method of claim 1 further including the step of:

injection molding the hook portion from a plastic material.

3. The method of claim 1 further including the step of:

applying a friction producing surface onto at least portions of at least one of the first and second shoulder rails and the horizontal rail.

4. The method of claim 3 wherein the step of applying the friction producing surface includes the steps of:

spraying at least portions of at least one of the first and second shoulder rails and the horizontal rail with an adhesive; and spraying flocking particles over the adhesive coating wherein the flocking particles are attached to at least portions of at least one of the first and second shoulder rails and the horizontal rail by the adhesive coating.

5. The method of claim 4 wherein the steps of spraying the adhesive and spraying the flocking particles are performed before the hollow tubular member is bent to form the first and second shoulder rails.

6. The method of claim 3 wherein the step of applying the friction producing surface includes the steps of:

spraying at least portions of certain of the first and second shoulder rails and the horizontal rail with an adhesive; and winding a plurality of strands into a braid over the adhesive coating wherein the braid is adhesively attached to at least portions of at least one of the first and second shoulder rails and the horizontal rail by the adhesive.

7. The method of claim 6 wherein the steps of spraying the adhesive and winding the braid over the adhesive are performed before the hollow tubular member is bent to form the first and second shoulder rails.

8. A two-part hanger including a hook portion having first and second inclined, depending legs preparable by the process of:

extruding an elongated, hollow, tubular member from a plastic material having first and second ends, and bending the first and second ends of the tubular member to form first and second inclined shoulder rails joined by an integral horizontal rail, the first and second ends of the shoulder rails engageable with the first and second legs, respectively, of the hook portion.

9. The two-part hanger of claim 8 further preparable by the process of:

spraying flocking fibers over an adhesive coating previously sprayed onto at least portions of at least one of the first and second shoulder rails and the horizontal rail before the first and second shoulder rails are bent in the tubular member.

10. The two-part hanger of claim 8 further preparable by the process of:

winding a plurality of strands into a braid over an adhesive coating previously sprayed onto at least portions of at least one of the first and second shoulder rails and the horizontal rail before the first and second shoulder rails are bent in the tubular member.

* * * * *